United States Patent [19]

Marks

[11] 4,219,287

[45] Aug. 26, 1980

[54] ROLLER ATTACHMENT FOR A VIBRATOR COMPACTOR

[76] Inventor: Paul Marks, 1313 NW. 97 Ave., Miami, Fla. 33172

[21] Appl. No.: 35,418

[22] Filed: May 2, 1979

[51] Int. Cl.[3] ..... E01C 19/38

[52] U.S. Cl. ..... 404/117; 404/113; 404/128

[58] Field of Search ..... 404/128, 123, 131, 122, 404/113, 103, 117; 29/115; 280/30, 33.99 S, 47.18

[56] References Cited

U.S. PATENT DOCUMENTS

| | | | |
|---|---|---|---|
| 1,017,430 | 2/1912 | Lilleberg | 404/123 |
| 1,364,605 | 1/1921 | Ashmore | 404/117 |
| 1,819,866 | 8/1931 | Cameron | 404/117 |
| 2,039,078 | 4/1936 | Hertwig | 404/113 X |
| 2,133,862 | 10/1938 | Kerns | 404/117 |
| 2,315,397 | 3/1943 | Butler | 404/128 X |
| 3,416,417 | 12/1968 | McIlrath | 404/113 X |
| 3,554,100 | 1/1971 | Mauldin | 404/117 |
| 4,040,761 | 8/1977 | Rahn | 404/128 X |

*Primary Examiner*—Nile C. Byers, Jr.

[57] ABSTRACT

A roller attachment for fixed engagement to any of a variety of conventional vibrator compactors to convert same into a vibrator roller device, the roller attachment including a generally rectangular bottom frame portion defining a generally rectangular central opening in which a plurality of spaced apart parallel rollers are rotatably carried; a top frame portion, fixed to the bottom frame portion, is configurated to receive the operating plate portion, of a conventional vibrator compactor, which is aligned with and bolted to the top frame, and removable rubber tubular treads are provided for the rollers.

10 Claims, 3 Drawing Figures

ROLLER ATTACHMENT FOR A VIBRATOR COMPACTOR

BACKGROUND OF THE INVENTION

The present invention pertains to vibrator compactors, and more particularly to a roller attachment for fixed attachment thereto. The roller attachment adapts a conventional plate type compactor for uses such as setting tile or brick pavers in sand beds, rolling in exposed gravel in concrete surfaces and other places, and including placing of terrazzo where a plate type compactor may not suit the purpose. Tubular resilient roller covers provided on the rollers may be removed for asphalt patching jobs.

Therefore, one of the principal objects of the present invention is to provide a frame and roller assembly for attachment to a conventional plate type of vibrator compactor to convert a conventional vibrator compactor of the plate type into a vibrator roller compactor.

A further object of the invention is to provide means to fix the roller attachment relative to the bottom of the vibrator plate of a conventional compactor, of the above type, in an aligned relation with the vibrator plate.

Yet another object of the instant invention is to provide removable resilient tubular covers or treads on the rollers, formed of a resilient material such as rubber or a suitable synthetic material.

DESCRIPTION OF A PREFERRED EMBODIMENT

Figure 1:
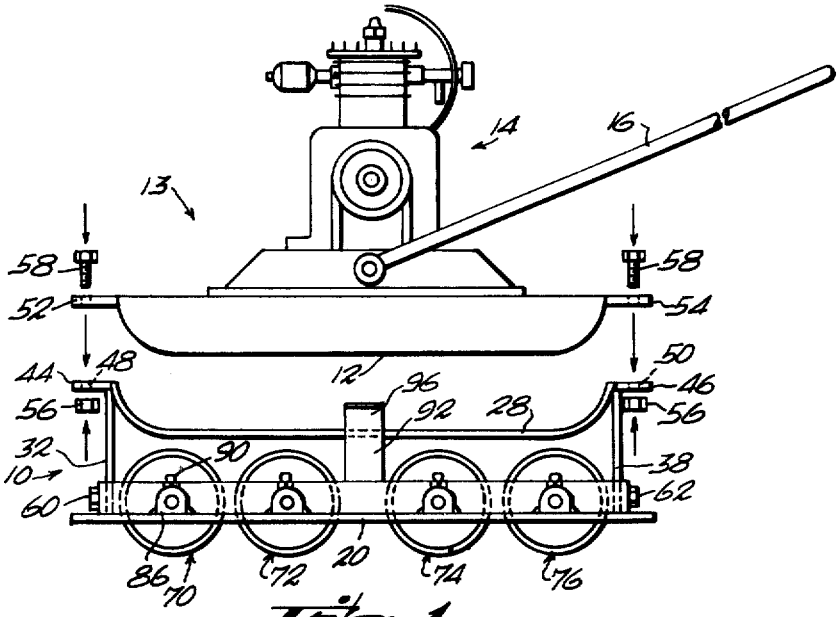
FIG. 1 is a side elevational view of the roller attachment of the present invention in an exploded relation to a conventional vibrator plate type of compactor.

With reference to the drawings in which like reference characters designate like or corresponding parts throughout the various views, and with particular reference to FIG. 1, the roller attachment, designated generally at 10, is illustrated in an exploded relation to the vibrator plate 12 of a conventional vibrator compactor 13 provided with an appropriate drive means 14 and operator handle 16.

In a preferred form, the attachment 10 includes a generally rectangular lower frame portion 18 formed of suitable structural members such as angle iron, including opposed side members 20, 22 and front and back members 24, 26.

A pair of upper longitudinal frame members 28, 30 are fixed as by welding between top ends of respective pairs of four corner posts 32, 34, 36 and 38 which are fixed at their lower ends to respective corner portions defined by th lower rectangular frame portion 18. The upper frame members are contoured to conform with the bottom contour of the vibrator plate 12 of the conventional compactor 13.

A pair of transverse plates 40, 42 are fixed as by welding between top ends of respective front and back pairs of corner posts 32, 34 and 36, 38. Front and back connector ears 44, 46, fixed centrally of transverse plates

40, 42 include through holes such as 48, 50 and a similar pair of holed ears 52, 54 are fixed to respective ends of the compactor plate in aligned relation with ears 44, 46 for the reception of attachment means such as nuts and bolts 56, 58.

Figure 2:
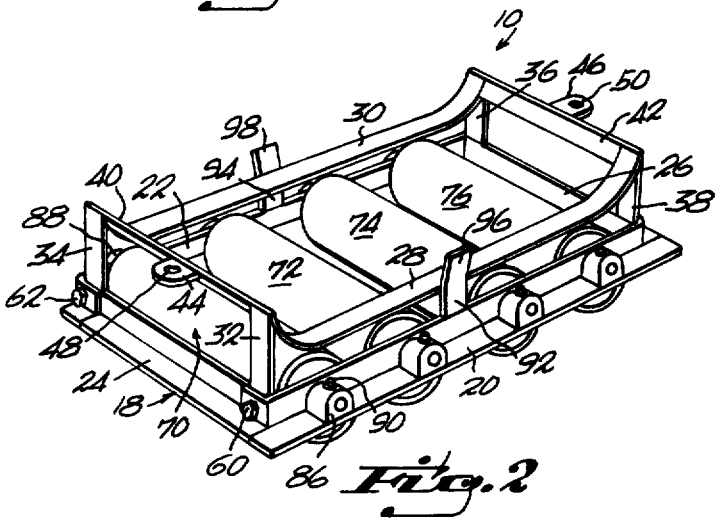
FIG. 2 is a three-quarter top perspective view of the roller attachment of the present invention.
Figure 3:
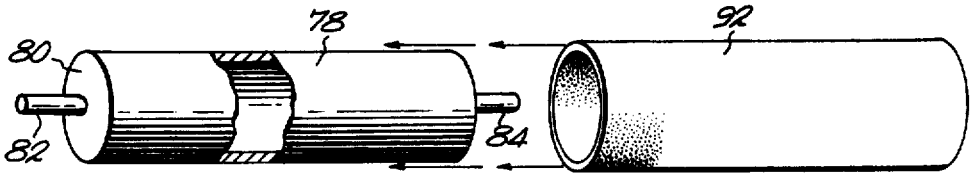
FIG. 3 is a perspective view of a typical roller utilized by the present invention, illustrating a removable, resilient tubular cover in an exploded relation therewith.

As illustrated in FIG. 2, the side angle iron frame members 20, 22 are bolted at both ends, as illustrated at 60, 62 to the front and back transverse angle iron frame members 24, 26. In practice, however, only one side member 20 or 22 need be removable to permit removal of the four rollers 70, 72, 74 and 76. As seen in FIG. 3, each roller 70 through 76 includes a round, preferably steel tubular body length 78 with end closure plates such as 80 with axially outwardly extending stub shafts 82, 84 from the respective end closure plates 80. The stub shafts 82, 84 of each roller such as 70 are rotatably journaled between bearing blocks 86, 88, fixed as by welding to the respective side angle iron members 20, 22. Each bearing such as 86, 88 is provided with an appropriate grease fitting 90.

As seen in FIG. 3, a removable, resilient tubular cover 92 is provided for the length of each roller 70 through 76. As above described, at least one of the side frame members 20, 22 may be removed for removal or installation of the covers 92 relative to the respective rollers. Covers 92 may be formed of rubber or a suitable synthetic material.

With further reference to FIG. 2, a pair of upwardly extending lugs 92, 94, fixed generally to mid-points of the respective lengths of frame members 20 and 22 include upwardly somewhat diverging portions 96, 98 above the upper frame members 28, 30 to guide the compactor 13 into a proper position for fixed engagement with the roller attachment 10.

What is claimed is:

1. A roller attachment assembly for removable attachment to a conventional vibrator compactor of a type having a generally longitudinally extending vibratory bottom plate, the roller attachment comprising a frame including, first, a generally rectangular bottom portion defining a generally rectangular central opening and, second, an upper portion, configurated to nestingly receive the vibrator compactor bottom plate and including attachment means to said bottom portion; a plurality of transversely extending, spaced apart parallel roller means disposed in said rectangular opening with journal means fixed to said frame bottom portion, and means to removably attach said frame relative to the compactor bottom plate.

2. The assembly as defined in claim 1 wherein each of said roller means includes a main transverse tubular length, formed of a suitable material such as steel, a pair of end closure plates, fixed relative to respective ends of said tubular length and a stub shaft extending axially outwardly from each of said end closure plates.

3. The assembly as defined in claim 2 including a resilient tubular cover of a suitable material such as rubber for removable slip-on engagement over said main tubular length.

4. The assembly as defined in claim 2 wherein said rectangular bottom portion is comprised of a pair of spaced apart, generally parallel, longitudinally extending side rail members interconnected at respective ends by front and back transverse rail members.

5. The assembly as defined in claim 4 wherein said journal means comprises a pair of journal blocks for each of said roller means, said journal blocks being fixed as by welding to respective said side rails for engagement by said end closure plate stub shafts.

6. The assembly as defined in claim 5 wherein at least one of said side rails is removably attached to said front and back transverse rail members to permit removal of said roller means from the assembly.

7. The assembly as defined in claim 6 including a grease fitting fixed to each of said bearing block to premit lubrication of each of said stub shafts.

8. The assembly as defined in claim 1 including means to properly position said roller attachment assembly relative to said bottom plate.

9. The assembly as defined in claim 8 wherein said means to properly position comprises a pair of lugs fixed respectively to opposed sides of said frame, generally midway of a main length thereof, said lugs extending a predetermined distance above said frame in somewhat upwardly outwardly diverging relation.

10. The assembly as defined in claim 1 wherein said means to removably attach comprises like pluralities of aligned lugs fixed respectively to said upper portion and bottom plate and including axially aligned through holes therein for reception of nut and bolt attachment means.

* * * * *